US008289245B2

(12) United States Patent
Araki

(10) Patent No.: US 8,289,245 B2
(45) Date of Patent: Oct. 16, 2012

(54) DISPLAY DEVICE, METHOD FOR DRIVING THE SAME, AND ELECTRONIC DEVICE

(75) Inventor: Shoji Araki, Kanagawa (JP)

(73) Assignee: Sony Corporation, Tokyo (JP)

( * ) Notice: Subject to any disclaimer, the term of this patent is extended or adjusted under 35 U.S.C. 154(b) by 368 days.

(21) Appl. No.: 12/507,998

(22) Filed: Jul. 23, 2009

(65) Prior Publication Data

US 2010/0026674 A1 Feb. 4, 2010

(30) Foreign Application Priority Data

Jul. 31, 2008 (JP) ..... 2008-197912

(51) Int. Cl.
*G09G 3/30* (2006.01)

(52) U.S. Cl. ..... 345/78; 345/80; 345/82; 345/206; 313/498

(58) Field of Classification Search ..... 345/76–80, 345/82, 204, 205, 206, 208, 690; 250/552, 250/553; 315/169.3; 313/498, 506, 512
See application file for complete search history.

(56) References Cited

U.S. PATENT DOCUMENTS

| | | | | |
|---|---|---|---|---|
| 7,764,248 | B2 * | 7/2010 | Yamamoto et al. | 345/36 |
| 7,804,469 | B2 * | 9/2010 | Asano | 345/78 |
| 2007/0115224 | A1 | 5/2007 | Yamamoto et al. | |
| 2008/0238901 | A1 * | 10/2008 | Taneda et al. | 345/204 |
| 2010/0039421 | A1 * | 2/2010 | Toyomura et al. | 345/212 |

FOREIGN PATENT DOCUMENTS

| | | |
|---|---|---|
| JP | 2004-171827 | 6/2004 |
| JP | 2007-108381 | 4/2007 |
| JP | 2007-133283 | 5/2007 |
| JP | 2007-133284 | 5/2007 |
| JP | 2008-033193 | 2/2008 |
| JP | 2009-069322 | 4/2008 |
| JP | 2009-157018 | 7/2008 |
| JP | 2008-191296 | 8/2008 |
| JP | 2008-256916 | 10/2008 |
| JP | 2009-008872 | 1/2009 |
| JP | 2009-008873 | 1/2009 |
| JP | 2009-008874 | 1/2009 |
| JP | 2009-204992 | 9/2009 |
| JP | 2009-294635 | 12/2009 |

OTHER PUBLICATIONS

Japanese Patent Office Action corresponding to Japanese Serial No. 2008-197912 dated Jul. 1, 2010.

* cited by examiner

*Primary Examiner* — Lun-Yi Lao
*Assistant Examiner* — Tom Sheng
(74) *Attorney, Agent, or Firm* — SNR Denton US LLP

(57) ABSTRACT

The present invention provides a display device, a method for driving the same, and an electronic device capable of making μ correction function reliably even in the case where light emission luminance is low. A potential difference between the gate and the source of a transistor is corrected to a threshold voltage of the transistor. After that, while a horizontal drive circuit outputs a third voltage Vofs2, correction of mobility of the transistor starts. Subsequently, while the horizontal drive circuit outputs a second voltage Vsig, writing of a voltage according to the second voltage Vsig to the gate of the transistor is started.

6 Claims, 12 Drawing Sheets

FIG. 6(A) GATE LINE POTENTIAL (WSL)
FIG. 6(B) SIGNAL LINE POTENTIAL (DTL)
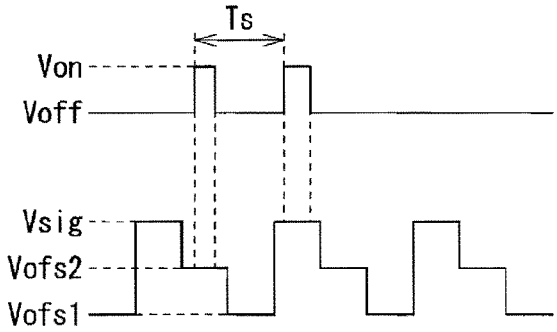
FIG. 7(A) GATE LINE POTENTIAL (WSL)
FIG. 7(B) SIGNAL LINE POTENTIAL (DTL)
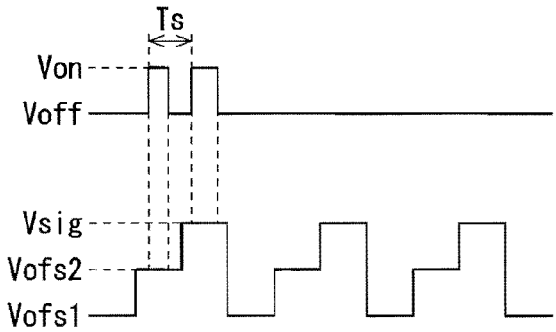
FIG. 8(A) GATE LINE POTENTIAL (WSL)
FIG. 8(B) SIGNAL LINE POTENTIAL (DTL)
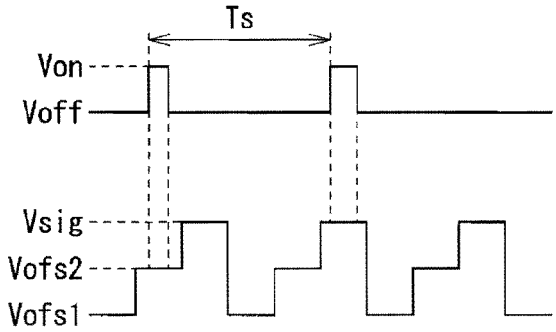

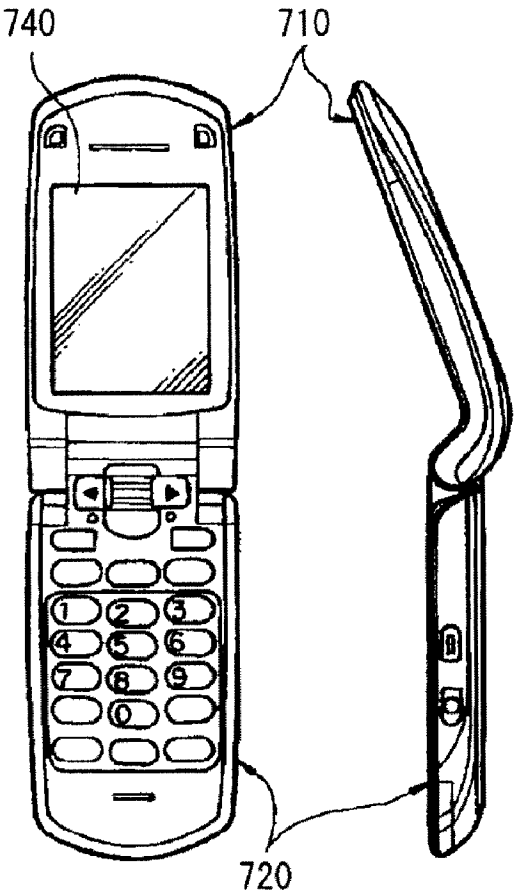
FIG. 14A
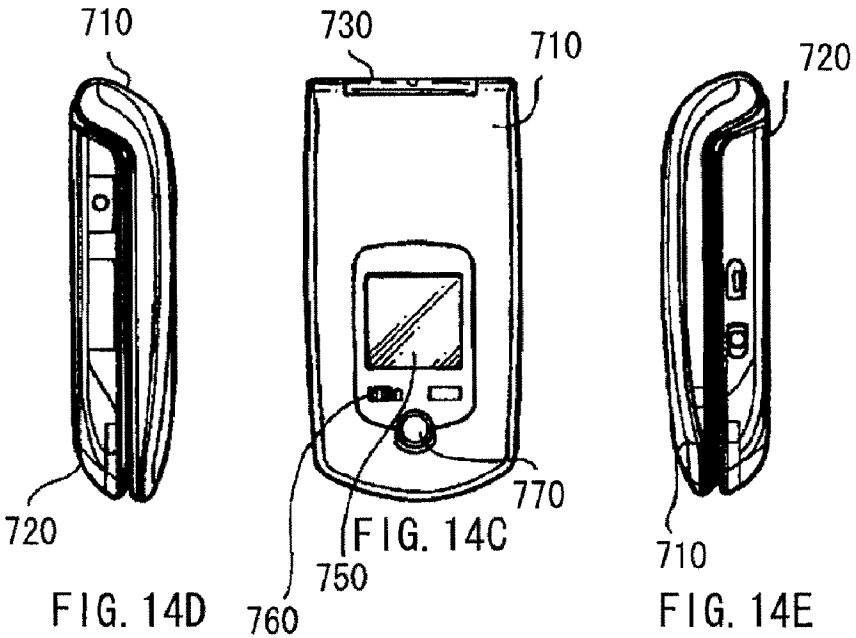
FIG. 14B
FIG. 14D
FIG. 14C
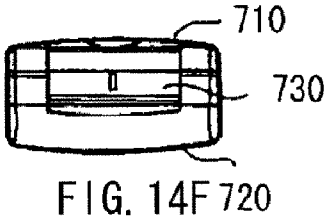
FIG. 14F
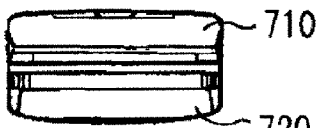
FIG. 14G

DISPLAY DEVICE, METHOD FOR DRIVING THE SAME, AND ELECTRONIC DEVICE

BACKGROUND OF THE INVENTION

1. Field of the Invention

The present invention relates to a display device including a display unit having a light emitting element and a pixel circuit for each of pixels, and a drive unit driving the pixel circuit, and to a method for driving the same. The present invention also relates to an electronic device having the display device.

2. Description of the Related Art

In recent years, in the field of a display device for displaying an image, a display device using, as a light emitting element of a pixel, an optical element of a current driving type whose light emission luminance changes according to the value of a flowing current, for example, an organic EL (Electro Luminance) element is developed and is being commercialized.

An organic EL element is a spontaneous light emitting element different from a liquid crystal element or the like. Consequently, in a display device using an organic EL element (organic EL display device), a light source (backlight) is unnecessary. As compared with a liquid crystal display device necessitating a light source, visibility of an image is higher, power consumption is lower, and response of the element is faster.

As driving methods of the organic EL display device, as in the liquid crystal display device, there are a simple (passive) matrix method and an active matrix method. The simple (passive) matrix method has, although the structure is simple, a disadvantage in that a large-sized high-resolution display device is difficult to be realized. Consequently, at present, the active matrix method is actively developed. In the active matrix method, current flowing in a light emitting element disposed for each pixel is controlled by an active element (generally, TFT (Thin Film Transistor)) provided in a drive circuit arranged for each of the light emitting elements.

Generally, a current-voltage (I-V) characteristic of the organic EL element deteriorates with time (time-dependent degradation). In a pixel circuit for current-driving an organic EL element, when the I-V characteristic of the organic EL element changes with time, the voltage dividing ratio between the organic EL element and a drive transistor connected in series with the organic EL element changes, so that voltage Vgs between the gate and the source of a drive transistor also changes. As a result, the value of current flowing in the drive transistor changes, so that the value of current flowing in the organic EL element also changes, and the light emission luminance also changes according to the current value.

There is a case that a threshold voltage Vth of the drive transistor and mobility μ change with time, or differ among pixel circuits due to variations in manufacturing processes. In the case where the threshold voltage Vth of the drive transistor and mobility μ differ among pixel circuits, the value of current flowing in the drive transistor varies among pixel circuits. Consequently, even when the same voltage is applied to the gate of the drive transistor, the light emission luminance of the organic EL element varies, and uniformity of a screen deteriorates.

A display device is developed, which has a function of compensating fluctuations in the I-V characteristic of an organic EL element and a function of correcting fluctuations in a threshold voltage Vth and mobility μ of a drive transistor in order to maintain the light emission luminance of the organic EL element without being influenced by variations with time in the I-V characteristic of the organic EL element and variations with time in the threshold voltage Vth of the drive transistor and the mobility μ (see, for example, Japanese Unexamined Patent Application Publication Nos. 2007-171827, 2007-108381, 2007-133283, and 2007-133284).

FIG. 15 illustrates an example of a schematic configuration of a display device in related art. A display device 100 illustrated in FIG. 15 has a display unit 110 in which a plurality of pixels 120 are disposed in a matrix, and a drive unit (a horizontal drive circuit 130, a write scan circuit 140, and a power source scan circuit 150) for driving each of the pixels 120.

Each pixel 120 includes a pixel 120R for red, a pixel 120G for green, and a pixel 120B for blue. As illustrated in FIG. 16, each of the pixels 120R, 120G, and 120B includes an organic EL element 121 (organic EL elements 121R, 121G, and 121B) and a pixel circuit 122 connected to the organic EL element 121. The pixel circuit 122 includes a transistor Tws for sampling, a retention capacitor Cs, and a transistor $T_{Dr}$ for driving, and has a circuit configuration of 2Tr1C. A gate line WSL led from the write scan circuit 140 is formed so as to extend in the row direction and is connected to the gate of the transistor Tws. A drain line DSL led from the power source scan circuit 150 is also formed so as to extend in the row direction, and is connected to the drain of the transistor $T_{Dr}$. A signal line DTL led from the horizontal drive circuit 130 is formed so as to extend in the column direction, and is connected to the drain of the transistor Tws. The source of the transistor Tws is connected to the gate of the transistor $T_{Dr}$ for driving and one end of the retention capacitor Cs. The source of the transistor $T_{Dr}$ and the other end of the retention capacitor Cs are connected to the anode of the organic EL element 121R, 121G, or 121B (hereinbelow, simply referred to as the organic EL element 121R or the like). The cathode of the organic EL element 121R or the like is connected to a cathode line CTL.

FIG. 17 illustrates an example of various waveforms in the display device 100 illustrated in FIG. 15. FIG. 17 illustrates a state where two kinds of voltages (Von and Voff (<Von)) are applied to the gate line WSL, two kinds of voltages (Vcc and Vini (<Vthe1+Vca)) are applied to the drain line DSL, and two kinds of voltages (Vsig and Vofs) are applied to the signal line DTL. Vthe1 denotes a threshold voltage of the organic EL element 121R or the like, and Vca denotes a cathode voltage of the organic EL element 121R or the like. Further, FIG. 17 illustrates a state where the gate voltage Vg and the source voltage Vs of the transistor $T_{Dr}$ change momentarily in accordance with application of the voltages to the gate line WSL, the drain line DSL and the signal line DTL.

Vth Correction Preparation Period

First, Vth correction is prepared. Concretely, the power source scan circuit 150 decreases the voltage of the drain line DSL from Vcc to Vini ($T_1$). The source voltage Vs decreases to Vini, and light of the organic EL element 121R or the like goes out. At this time, the gate voltage Vg also decreases due to coupling via the retention capacitor Cs. Next, while the voltage of the signal line DTL is Vofs, the write scan circuit 140 increases the voltage of the gate line WSL from Voff to Von ($T_2$). As a result, the transistor Tws is turned on, and the gate voltage Vg of the transistor $T_{Dr}$ decreases to Vofs.

First Vth Correction Period

Next, Vth is corrected. Concretely, while the voltage of the signal line DTL is Vofs, the power source scan circuit 150 increases the voltage of the drain line DSL from Vini to Vcc ($T_3$). Current Ids flows between the drain and source of the transistor $T_{Dr}$, so that the retention capacitor Cs and an element capacitor (not illustrated) such as the organic EL element 121R or the like are charged, and the source voltage Vs rises. After lapse of a predetermined period, the write scan circuit 140 decreases the voltage of the gate line WSL from Von to Voff ($T_4$). The transistor Tws is turned off, the gate of the transistor $T_{Dr}$ floats, and correction of Vth is temporarily stopped.

First Vth Correction Stop Period

In a period in which Vth correction stops, the voltage of the signal line DTL is sampled in another row (pixel) different from a row (pixel) subjected to the Vth correction. In the case where the Vth correction is insufficient, that is, in the case where a potential difference Vgs between the gate and the source of the transistor $T_{Dr}$ is larger than threshold voltage Vth of the transistor $T_{Dr}$, also in the Vth correction stop period, in the row (pixel) subjected to the Vth correction, current Ids flows between the drain and source of the transistor $T_{Dr}$, the source voltage Vs rises, and the gate voltage Vg also rises by the coupling via the retention capacitor Cs. Since reverse bias is applied to the organic EL element 121R or the like, the organic EL element 121R or the like does not emit light.

Second Vth Correction Period

After completion of the Vth correction stop period, Vth is corrected again. Concretely, when the voltage of the signal line DTL is Vofs and Vth correction is possible, the write scan circuit 140 increases the voltage of the gate line WSL from Voff to Von ($T_5$) and connects the gate of the transistor $T_{Dr}$ to the signal line DTL. In the case where the source voltage Vs is lower than Vofs−Vth (in the case where the Vth correction has not been completed), the current Ids flows between the drain and source of the transistor $T_{Dr}$ until the transistor $T_{Dr}$ cuts off (until the voltage difference Vgs becomes Vth). As a result, the retention capacitor Cs is charged to Vth, and the potential difference Vgs becomes Vth. After that, before the horizontal drive circuit 130 switches the voltage of the signal line DTL from Vofs to Vsig, the write scan circuit 140 decreases the voltage of the gate line WSL from Von to Voff ($T_6$). The gate of the transistor $T_{Dr}$ floats so that the potential difference Vgs may be maintained at Vth irrespective of the magnitude of the voltage of the signal line DTL. By setting the potential difference Vgs to Vth as described above, also in the case where the threshold voltage Vth of the transistor $T_{Dr}$ varies among the pixel circuits 122, light emission luminance of the organic EL elements 121R or the like may be prevented from varying.

Second Vth Correction Stop Period

After that, in the Vth correction stop period, the horizontal drive circuit 130 switches the voltage of the signal line DTL from Vofs to Vsig.

Write and μ Correction Period

After completion of the Vth correction stop period, writing and μ correction are performed. Concretely, while the voltage of the signal line DTL is Vsig, the write scan circuit 140 increases the voltage of the gate line WSL from Voff to Von ($T_7$) and connects the gate of the transistor $T_{Dr}$ to the signal line DTL. As a result, the voltage of the gate of the transistor $T_{Dr}$ becomes Vsig. The voltage of the anode of the organic EL element 121R or the like is still smaller than threshold voltage Vel of the organic EL element 121R or the like at this stage, and the organic EL element 121R or the like cuts off. Consequently, the current Ids flows to an element capacitor (not illustrated) of the organic EL element 121R or the like, and the element capacitor is charged. The source voltage Vs rises only by ΔV, and the potential difference Vgs becomes Vsig−Vofs+Vth−ΔV. In such a manner, μ correction is performed at the same time with the writing. The larger the mobility μ of the transistor $T_{Dr}$ is, the larger ΔV becomes. Therefore, by decreasing the potential difference Vgs only by ΔV before light emission, the variations in the mobility μ per pixel may be eliminated.

Light Emission

Finally, the write scan circuit 140 decreases the voltage of the gate line WSL from Von to Voff ($T_8$). The gate of the transistor $T_{Dr}$ floats, the current Ids flows between the drain and source of the transistor $T_{Dr}$, and the source voltage Vs rises. As a result, the organic EL element 121R or the like emits light with desired luminance.

SUMMARY OF THE INVENTION

As described above, the potential difference Vg between the gate and the source of the transistor $T_{Dr}$ finally becomes Vsig−Vofs+Vth−ΔV, and variations in the mobility μ of each pixel is corrected with ΔV. However, ΔV itself does not contribute to correction of the mobility μ. The difference (ΔΔV) between ΔV (ΔVa) of a transistor $T_{Dr}$ having the largest mobility μ in all of the transistors $T_{Dr}$ and ΔV (ΔVb) of a transistor $T_{Dr}$ having the smallest mobility μ in all of the transistors $T_{Dr}$ is used as a correction amount for realizing uniformity of luminance in an actual screen.

Each of FIGS. 18 and 19 illustrates an example of the relation between the μ correction time Ts and ΔVa, ΔVb, and ΔΔV. FIG. 18 illustrates the case where the signal voltage Vsig is large (that is, light emission luminance is high). FIG. 19 illustrates the case where the signal voltage Vsig is small (that is, light emission luminance is low). It may be said from FIGS. 18 and 19 that, when the light emission luminance is high, ΔΔV is large to some extent, so that μ correction functions. However, the mobility of the transistor $T_{Dr}$ is corrected using the voltage Vsig which changes according to the light emission luminance. When the light emission luminance is low, that is, when the voltage Vsig is small, ΔΔV is extremely small, and the μ correction does not function. Since the μ correction and the signal writing are performed simultaneously, the μ correction time Ts becomes inevitably short. Therefore, it is difficult to increase the μ correction time Ts and increase ΔΔV. As the Δ correction time Ts is increased, the rise ratio of ΔΔV becomes dull and is saturated to a certain value. Consequently, even if the μ correction time Ts is made longer, it may not be expected that ΔΔV becomes large.

It is therefore desirable to provide a display device capable of reliably making μ correction function even in the case where light emission luminance is low, a method of driving the same, and an electronic device.

According to an embodiment of the present invention, there is provided a display device including a display unit having a light emitting element and a pixel circuit for each of pixels, and a drive unit driving the pixel circuit. The pixel circuit includes at least a transistor connected in series to the light emitting element. The drive unit has a first drive unit, a second drive unit, and a control unit. The first drive unit supplies a first voltage capable of applying a voltage equal to or larger than a threshold voltage of the light emitting element to the light emitting element, from a source or a drain of the transistor, which is on the side opposite to the light emitting element. The second drive unit supplies a second voltage having a magnitude according to the video signal and a third voltage having a predetermined magnitude from the gate side of the transistor. The control unit corrects the potential difference between the gate and the source of the transistor to a threshold voltage of the transistor, after that, while the second drive unit outputs the third voltage, outputs a control signal starting correction of mobility of the transistor and, subsequently, while the second drive unit outputs the second voltage, outputs a control signal starting writing of a voltage according to the second voltage to the gate of the transistor.

According to an embodiment of the present invention, there is provided an electronic device having the above-mentioned display device.

According to an embodiment of the present invention, there is provided a method of driving the display device that has the structure mentioned above executing the steps of correcting the potential difference between the gate and the source of the transistor to a threshold voltage of the transistor, after that, while the second drive unit outputs the third voltage, starting correction of mobility of the transistor and, subsequently, while the second drive unit outputs the second voltage, starting writing of a voltage according to the second voltage to the gate of the transistor.

The display device for which the above-mentioned driving method is used has: a display unit having a light emitting element and a pixel circuit for each of pixels; and a drive unit driving the pixel circuit. The pixel circuit includes at least a transistor connected in series to the light emitting element. The drive unit has a first drive unit and a second drive unit. The first drive unit supplies a first voltage capable of applying a voltage equal to or larger than a threshold voltage of the light emitting element to the light emitting element, from a source or a drain of the transistor, which is on the side opposite to the light emitting element. The second drive unit supplies a second voltage having a magnitude according to the video signal and a third voltage having a predetermined magnitude from the gate side of the transistor.

In the display device, the method of driving the same, and the electronic device of the embodiment of the present invention, the potential difference between the gate and the source of the transistor is corrected to a threshold voltage of the transistor. After that, while the second drive unit outputs the third voltage, correction of mobility of the transistor is started. Subsequently, while the second drive unit outputs the second voltage, writing of a voltage according to the second voltage to the gate of the transistor starts. In such a manner, correction of mobility of the transistor and writing of the voltage according to the second voltage to the gate of the transistor (hereinbelow, simply referred to as writing to the gate) are performed separately. Therefore, time necessary to correct mobility of the transistor may be set freely. Since mobility of the transistor is corrected by using the third voltage having the predetermined magnitude, the mobility of the transistor may be corrected irrespective of the light emission luminance.

In the display device, the method of driving the same, and the electronic device of the embodiment of the present invention, the potential difference between the gate and the source of the transistor is corrected to a threshold voltage of the transistor. After that, while the second drive unit outputs the third voltage, correction of mobility of the transistor is started. Subsequently, while the second drive unit outputs the second voltage, writing of a voltage according to the second voltage to the gate of the transistor starts. Therefore, time necessary to correct mobility of the transistor may be set freely. Further, mobility of the transistor is corrected irrespective of the light emission luminance. Consequently, even in the case where the light emission luminance is low, μ correction may be made function reliably.

Other and further objects, features and advantages of the invention will appear more fully from the following description.

BRIEF DESCRIPTION OF THE DRAWINGS

FIG. 6 is a waveform chart illustrating an example of combination between waveform of a gate line and waveform of a signal line.

FIG. 7 is a waveform chart illustrating another example of the combination of the waveform of the gate line and the waveform of the signal line.

FIG. 8 is a waveform chart illustrating another example of the combination of the waveform of the gate line and the waveform of the signal line.

FIG. 14A is a front view in an open state of application example 5, FIG. 14B is a side view in the open state, FIG. 14C is a front view in a closed state, FIG. 14D is a left side view, FIG. 14E is a right side view, FIG. 14F is a top view, and FIG. 14G is a bottom view.

DETAILED DESCRIPTION OF THE PREFERRED EMBODIMENTS

Embodiments of the present invention will be described in detail hereinbelow with reference to the drawings.

Figure 1:
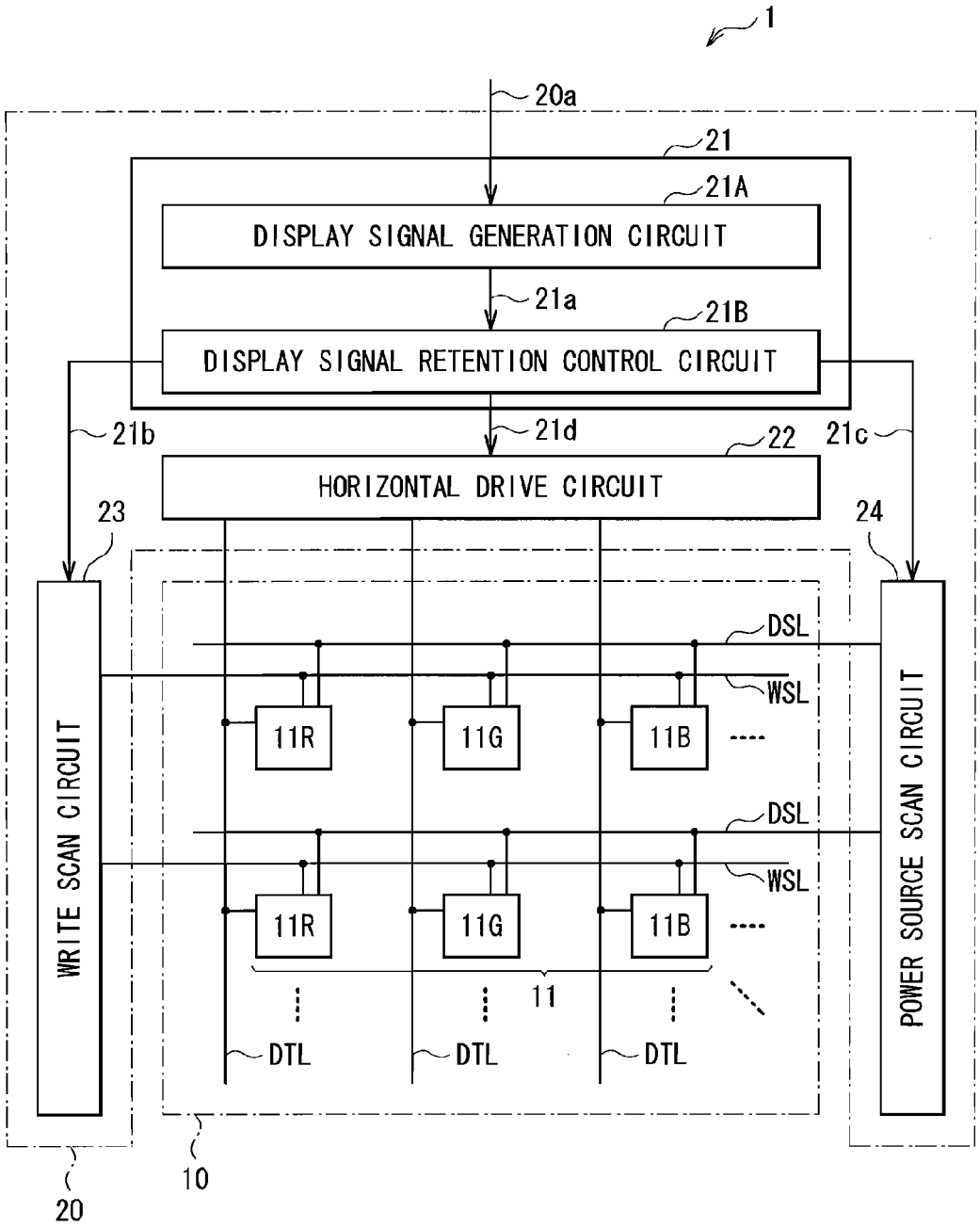
FIG. 1 is a configuration diagram illustrating an example of a display device as an embodiment of the present invention.

FIG. 1 illustrates an example of a general configuration of a display device 1 according to an embodiment of the present invention. The display device 1 has, on a substrate (not illustrated) made of, for example, glass, silicon (Si) wafer, a resin, or the like, a display unit 10 and a peripheral circuit unit 20 (drive unit) formed in the periphery of the display unit 10.

The display unit 10 has a configuration in which a plurality of pixels 11 are arranged in a matrix on an entire surface of the display unit 10, and displays an image based on a video signal 20*a* input from the outside by active matrix drive. Each pixel 11 includes a pixel 11R for red, a pixel 11G for green, and a pixel 11B for blue.

Figure 2:
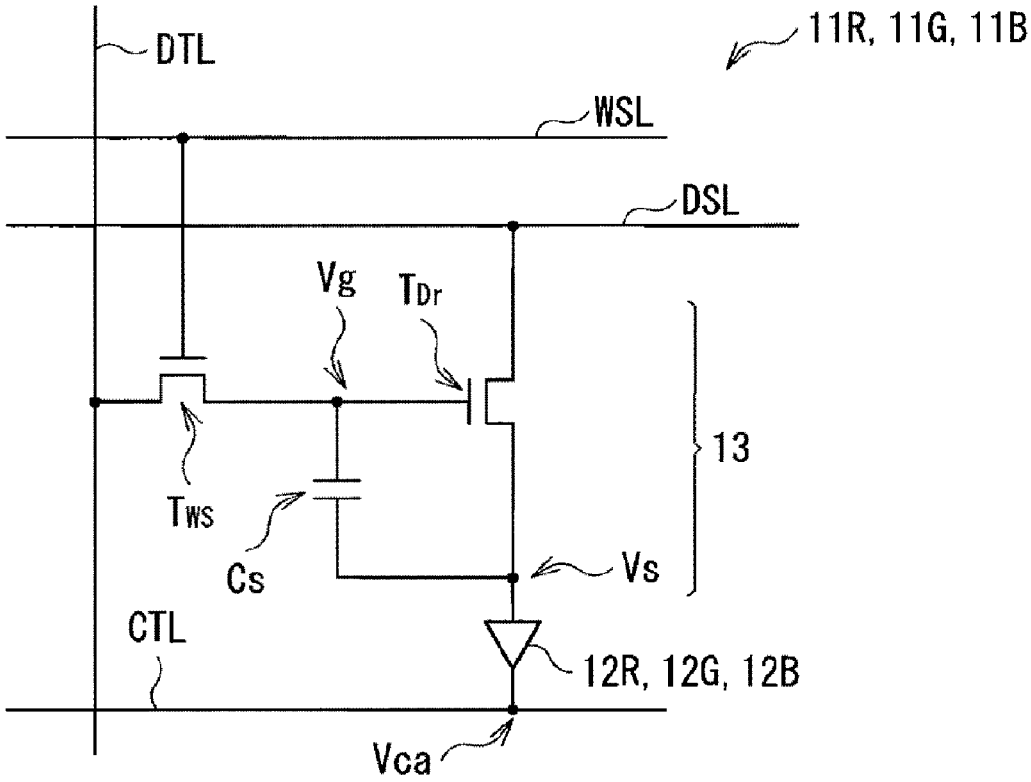
FIG. 2 is a configuration diagram illustrating an example of an internal configuration of a pixel in FIG. 1.

FIG. 2 illustrates an example of an internal configuration of the pixels 11R, 11G, and 11B. As illustrated in FIG. 2, the pixels 11R, 11G, and 11B have therein organic EL elements 12R, 12G, 12B (light emitting elements), respectively, and a pixel circuit 13.

Each of organic EL elements 12R, 12G, and 12B (hereinbelow, simply referred to as the organic EL element 12R or the like) has, for example, although not illustrated, a configuration in which an anode, an organic layer, and a cathode are stacked in order on a substrate 11. The organic layer has a stack-layer structure obtained by stacking, for example, in order from the side of the anode, a hole injection layer for increasing hole injection efficiency, a hole transport layer for increasing hole transport efficiency to a light emission layer, a light emission layer for emitting light by recombination of electrons and holes, and an electron transport layer for increasing efficiency of transporting electrons to the light emission layer.

The pixel circuit 13 includes a transistor Tws for sampling, a retention capacitor Cs, and a transistor $T_{Dr}$ for driving, and has a circuit configuration of 2Tr1C. Each of the transistors Tws and $T_{Dr}$ is configured by, for example, an n-channel MOS-type thin film transistor (TFT). The transistor $T_{Dr}$ corresponds to a concrete example of a "transistor" of the present invention.

The peripheral circuit unit 20 has a timing control circuit 21 (control unit), a horizontal drive circuit 22 (second drive unit), a write scan circuit 23, and a power source scan circuit 24 (first drive unit). The timing control circuit 21 includes a display signal generation circuit 21A and a display signal retention control circuit 21B. The peripheral circuit unit 20 is provided with a gate line WSL, a drain line DSL, a signal line DTL, and a cathode line CTL. The cathode line CTL is connected to the ground and is set at the ground voltage.

On the basis of the video signal 20*a* input from the outside, the display signal generation circuit 21A generates a display signal 21*a* for displaying an image on the display unit 10, for example, screen by screen (field by field).

The display signal retention control circuit 21B stores and retains the display signal 21*a* output from the display signal generation circuit 21A in a field memory such as an SRAM (Static Random Access Memory) screen by screen (field by field). The display signal retention control circuit 21B also plays the role of controlling the horizontal drive circuit 22, the write scan circuit 23, and the power source scan circuit 24 for driving the pixels 11 so as to operate interlockingly. Concretely, the display signal retention control circuit 21B outputs a control signal 21*b* to the write scan circuit 23, outputs a control signal 21*c* to the power source scan circuit 24, and outputs a control signal 21*d* to the display signal drive circuit 21C.

The horizontal drive circuit 22 is possible to output three kinds of voltages (Vofs1, Vofs2 (third voltage), and Vsig (second voltage)) in accordance with the control signal 21*d* output from the display signal retention control circuit 21B. Concretely, the horizontal drive circuit 22 supplies the three kinds of voltages (Vofs1, Vofs2, and Vsig) to the pixel 11 selected by the write scan circuit 23 via the signal line DTL connected to the pixels 11 in the display unit 10.

In this case, Vofs2 is a voltage value higher than Vofs1 and is, for example, a voltage value in the range of the maximum voltage of Vsig or less. Vsig is a voltage value corresponding to the video signal 20*a*. The minimum voltage of Vsig has a voltage value lower than Vofs1, and the maximum voltage of Vsig has a voltage value higher than Vofs1.

The write scan circuit 23 is possible to output two kinds of voltages (Von and Voff) in accordance with the control signal 21*b* output from the display signal retention control circuit 21B. Concretely, the write scan circuit 23 supplies the two kinds of voltages (Von and Voff) to the pixel 11 to be driven via the gate line WSL connected to the pixels 11 in the display unit 10 and controls the transistor Tws for sampling.

At this time, Von is a value equal to or higher than the on-voltage of the transistor Tws. Von is a voltage value output from the write scan circuit 23 in a "Vth correction period", a "μ correction period", a "signal write period" or the like which will be described later. Voff is a value lower than the on-voltage of the transistor Tws and is also a value lower than Von. Voff is a voltage value output from the write scan circuit 23 in a "Vth correction preparation period", "Vth correction stop period", a "light emission period", or the like which will be described later.

The power source scan circuit 24 is possible to output two kinds of voltages (Vini and Vcc (first voltage)) in accordance with the control signal 21*c* output from the display signal retention control circuit 21B. Concretely, the power source scan circuit 24 supplies the two kinds of voltages (Vini and Vcc) to the pixel 11 to be driven via the drain line DSL connected to the pixels 11 of the display unit 10, and controls light-on and light-off of the organic EL element 12R or the like.

Vini denotes a voltage value lower than a voltage (Vel+Vca) obtained by adding the threshold voltage Vel of the organic EL element 12R or the like and the voltage Vca of the cathode of the organic EL element 12R or the like. Vcc denotes a voltage value equal to or higher than the voltage (Vel+Vca).

With reference to FIG. 2, the connection relation of the components will be described. The gate line WSL led from the write scan circuit 23 is formed so as to extend in the row direction and is connected to the gate of the transistor Tws. The drain line DSL led from the power source scan circuit 24 is also formed so as to extend in the row direction and is connected to the drain of the transistor $T_{Dr}$. The signal line DTL led from the horizontal drive circuit 22 is formed so as to extend in the column direction and is connected to the drain of the transistor Tws. The source of the transistor Tws is connected to the gate of the transistor $T_{Dr}$ for driving and one end of the retention capacitor Cs. The source of the transistor $T_{Dr}$ and the other end of the retention capacitor Cs are connected to the anode of the organic EL element 12R or the like. The cathode of the organic EL element 12R or the like is connected to the cathode line CTL.

The cathode line CTL is connected to a voltage source (not illustrated). The voltage source supplies a predetermined voltage (for example, ground voltage) to the cathode line CTL. The voltage source is connected also to the horizontal drive circuit 22, the write scan circuit 23, and the power source scan circuit 24, supplies Vofs1, Vofs2, and Vsig to the horizontal drive circuit 22, supplies Von and Voff to the write scan circuit 23, and supplies Vcc and Vss to the power source scan circuit 24.

The operation (operation from light-off to light-on) of the display device 1 of the embodiment will now be described. In the embodiment, an operation of compensating fluctuations in the I-V characteristic of the organic EL element 12R or the like and an operation of correcting fluctuations in the threshold voltage Vth and mobility μ of the transistor $T_{Dr}$ are included to maintain the light emission luminance of the organic EL element 12R or the like constant without being influenced by variations with time in the I-V characteristic of the organic EL element 12R or the like and variations with time in the threshold voltage Vth and the mobility μ of the transistor $T_{Dr}$.

Figure 3:
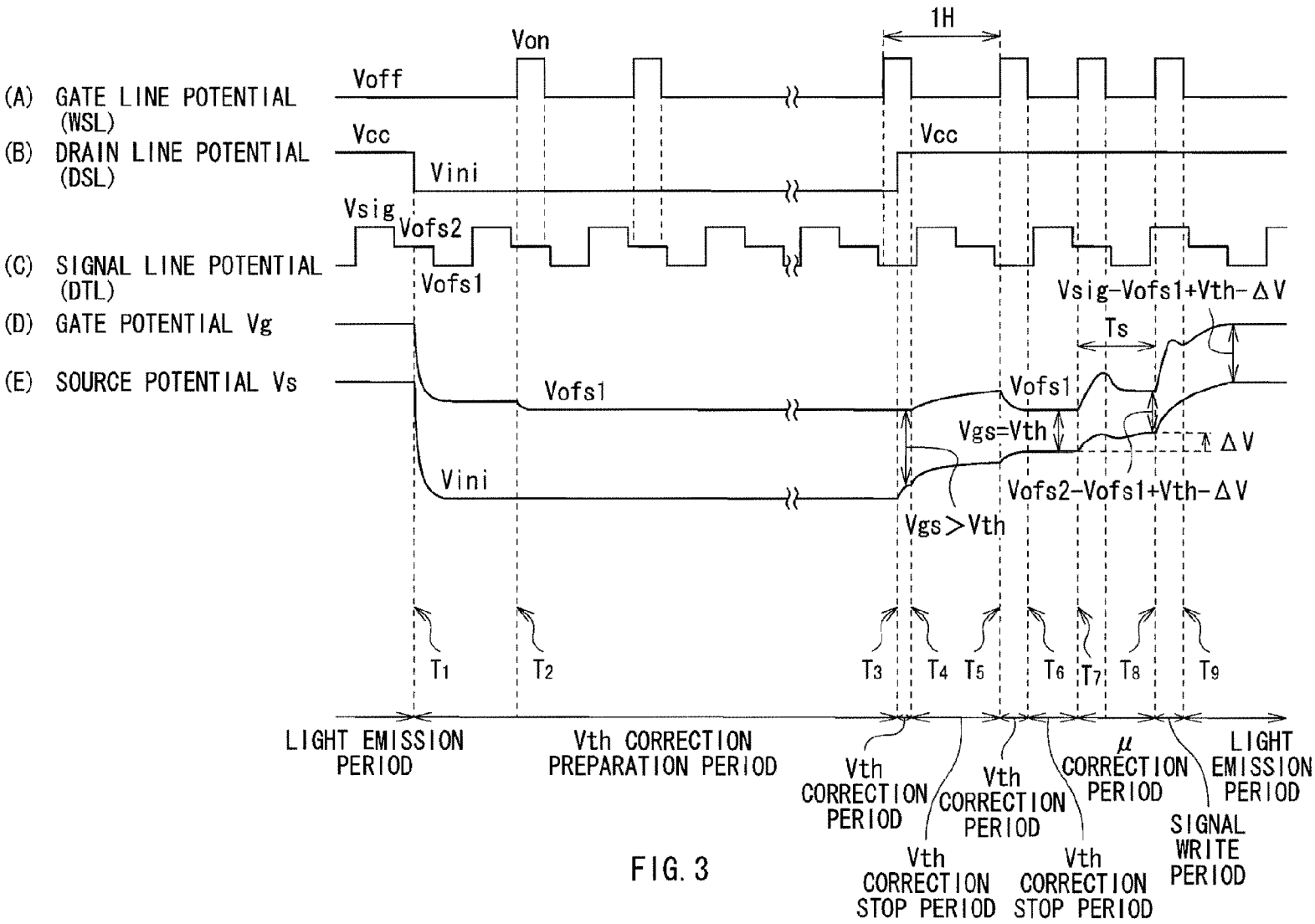
FIG. 3 is a waveform chart for explaining an example of the operation of the display device of FIG. 1.

FIG. 3 illustrates an example of various waveforms in the display device 1. FIG. 3 illustrates a state where voltage changes occur momentarily in the gate line WSL, the power source line PSL, and the signal line DTL. FIG. 3 also illustrates a state where the gate voltage Vg and the source voltage Vs change momentarily in accordance with voltage changes in the gate line WSL, the drain line DSL, and the signal line DTL.

Vth Correction Preparation Period

First, Vth correction is prepared. Concretely, when the voltage of the gate line WSL is Voff, the voltage of the signal line DTL is Vofs1, and the voltage of the drain line DSL is Vcc (that is, the organic EL element 12R or the like emits light), the power source scan circuit 24 decreases the voltage of the drain line DSL from Vcc to Vini in accordance with the control signal 21*c* ($T_1$). The source voltage Vs decreases to Vini, and light of the organic EL element 12R or the like goes out. At this time, the gate voltage Vg also decreases due to coupling via the retention capacitor Cs. Next, while the voltage of the drain line DSL is Vini and the voltage of the signal line DTL is Vofs1, the write scan circuit 23 increases the voltage of the gate line WSL from Voff to Von in accordance with the control signal 21*b* ($T_2$). As a result, the gate voltage Vg drops to Vofs1. After that, when the voltage of the drain line DSL is Vini and the voltage of the signal line DTL is Vofs1, the write scan circuit 23 increases the voltage of the gate line WSL from Voff to Von in accordance with the control signal 21*b*.

First Vth Correction Period

Next, Vth is corrected. Concretely, while the voltage of the signal line DTL is Vofs1, the power source scan circuit 24 increases the voltage of the drain line DSL from Vss to Vcc in accordance with the control signal 21*c* ($T_3$). Current Ids flows between the drain and source of the transistor $T_{Dr}$, and the source voltage Vs rises. After that, before the horizontal drive circuit 22 switches the voltage of the signal line DTL from Vofs1 to Vsig in accordance with the control signal 21*d*, the write scan circuit 23 decreases the voltage of the gate line WSL from Von to Voff in accordance with the control signal 21*b* ($T_4$). The gate of the transistor $T_{Dr}$ floats, and correction of Vth is temporarily stopped.

First Vth Correction Stop Period

In a period in which Vth correction stops (that is, the voltage of the gate line WSL is Voff and the voltage of the drain line DSL is Vcc), the voltage of the signal line DTL is sampled in another row (pixel) different from a row (pixel) subjected to the Vth correction. Concretely, the horizontal drive circuit 22 switches the voltage of the signal line DTL from Vofs1 to Vsig during the period in which the Vth correction stops and, after that, performs an operation of switching the voltage from Vsig to Vofs1 and Vofs2 step by step. During the period in which the voltage of the signal line DTL is Vsig, Vofs1, or Vofs2, the write scan circuit 23 increases the voltage of the gate line WSL connected to another row (pixel) different from the row (pixel) subjected to the Vth correction from Voff to Von and, after that, switches the voltage from Von to Voff.

In the case where the Vth correction is insufficient, that is, in the case where the potential difference Vgs between the gate and the source of the transistor $T_{Dr}$ is larger than threshold voltage Vth of the transistor $T_{Dr}$, also in the Vth correction stop period, in the row (pixel) subjected to the Vth correction, the current Ids flows between the drain and source of the transistor $T_{Dr}$, the source voltage Vs rises, and the gate voltage Vg also rises by the coupling via the retention capacitor Cs.

Second Vth Correction Period

After completion of the Vth correction stop period, Vth is corrected again. Concretely, when the voltage of the drain line DSL is Vcc, the voltage of the signal line DTL is Vofs1, and Vth correction is possible, the write scan circuit 23 increases the voltage of the gate line WSL from Voff to Von in accordance with the control signal 21*b* ($T_5$) and connects the gate of the transistor $T_{Dr}$ to the signal line DTL. In the case where the source voltage Vs is lower than Vofs−Vth (in the case where the Vth correction has not been completed), the current Ids flows between the drain and source of the transistor $T_{Dr}$ until the transistor $T_{Dr}$ cuts off (until the voltage difference Vgs becomes Vth). As a result, the gate voltage Vg becomes Vofs1 and the source voltage Vs rises. As a result, the retention capacitor Cs is charged to Vth, and the potential difference Vgs becomes Vth. After that, before the horizontal drive circuit 22 switches the voltage of the signal line DTL from Vofs1 to Vsig, the write scan circuit 23 decreases the voltage of the gate line WSL from Von to Voff ($T_6$). The gate of the transistor $T_{Dr}$ floats so that the potential difference Vgs is maintained at Vth irrespective of the magnitude of the voltage of the signal line DTL. By setting the potential difference Vgs to Vth as described above, also in the case where the threshold voltage Vth of the transistor $T_{Dr}$ varies among the pixel circuits 13, light emission luminance of the organic EL elements 12R or the like may be prevented from varying.

Second Vth Correction Stop Period

After that, in the Vth correction stop period (that is, in the period in which the voltage of the gate line WSL is Voff and the voltage of the drain line DSL is Vcc), the horizontal drive circuit 22 switches the voltage of the signal line DTL step by step from Vofs1 to Vsig and Vofs2 in accordance with the control signal 21d.

μ Correction Period

After completion of the second Vth correction stop period, μ correction is performed. Concretely, while the voltage of the signal line DTL is Vofs2, the write scan circuit 23 increases the voltage of the gate line WSL from Voff to Von in accordance with the control signal 21*b* ($T_7$) and connects the gate of the transistor $T_{Dr}$ to the signal line DTL. As a result, the voltage of the gate of the transistor $T_{Dr}$ becomes the voltage Vofs2 of the signal line DTL. The voltage of the anode of the organic EL element 12R or the like is smaller than threshold voltage Vel of the organic EL element 12R or the like at this stage, and the organic EL element 12R or the like cuts off. Consequently, the current Ids flows to an element capacitor (not illustrated) of the organic EL element 12R or the like, and the element capacitor is charged. The source voltage Vs rises only by ΔV, and the potential difference Vgs becomes Vofs2−Vofs1+Vth−ΔV. In such a manner, μ correction is performed. The larger the mobility μ of the transistor $T_{Dr}$ is, the larger ΔV becomes. Therefore, by decreasing the potential difference Vgs only by ΔV before light emission, the variations in the mobility μ per pixel may be eliminated.

After that, the write scan circuit 23 decreases the voltage of the gate line WSL from Von to Voff in accordance with the control signal 21*b*. Subsequently, when the voltage from the drain line DSL is Vcc and the voltage of the gate line WSL is Voff, the horizontal drive circuit 22 switches the voltage of the signal line DTL step by step from Vofs2 to Vofs1 and Vsig in accordance with the control signal 21*d*.

Signal Write Period

Following the μ correction, signal writing is performed. Concretely, while the voltage of the signal line DTL is Vsig, the write scan circuit 23 increases the voltage of the gate line WSL from Voff to Von in accordance with the control signal 21*b* ($T_8$) and connects the gate of the transistor $T_{Dr}$ to the signal line DTL. The voltage of the gate of the transistor $T_{Dr}$ becomes the voltage Vsig of the signal line DTL (or the voltage corresponding to the Vsig). The voltage of the anode of the organic EL element 12R or the like is still smaller than the threshold voltage Vel of the organic EL element 12R or the like even at this stage, and the organic EL element 12R or the like is in a cutoff state. Consequently, the current Ids flows to an element capacitor (not illustrated) of the organic EL element 12R or the like, and the element capacitor is charged. The source voltage Vs rises only by ΔV, and the potential difference Vgs becomes Vsig−Vofs1+Vth−ΔV. In such a manner, the signal writing operation is performed. In the case where the μ correction was not sufficiently performed in the preceding μ correction period (that is, in the case where the μ correction time Ts is not sufficiently long), the μ correction is performed also in the signal writing period.

Light Emission

Finally, the write scan circuit 23 decreases the voltage of the gate line WSL from Von to Voff in accordance with the control signal 21*b* ($T_9$). The gate of the transistor $T_{Dr}$ floats, the current Ids flows between the drain and source of the transistor $T_{Dr}$, and the source voltage Vs rises. As a result, a voltage equal to or higher than the threshold voltage Vel is applied to the organic EL element 12R or the like, and the organic EL element 12R or the like emits light with desired luminance.

In the display device 1 of the embodiment, as described above, the pixel circuit 13 is on/off controlled in each of the pixels 11, and drive current flows in the organic EL element 12R or the like in each of the pixels 11, so that recombination of holes and electrons occurs and light emits. The light is multi-reflected between the anode and the cathode, passes the cathode or the like, and is taken to the outside. As a result, an image is displayed on the display unit 10.

As described above, the potential difference Vg between the gate and the source of the transistor $T_{Dr}$ finally becomes Vsig−Vofs+Vth−ΔV, and variations in the mobility μ in each of the pixels are corrected with ΔV. However, ΔV itself does not contribute to correction of the mobility μ. The difference (ΔΔV) between ΔV (ΔVa) of a transistor $T_{Dr}$ having the largest mobility μ in all of the transistors $T_{Dr}$ and ΔV (ΔVb) of a transistor $T_{Dr}$ having the smallest mobility μ in all of the transistors $T_{Dr}$ is used as a correction amount for realizing uniformity of luminance in an actual screen.

Figure 4:
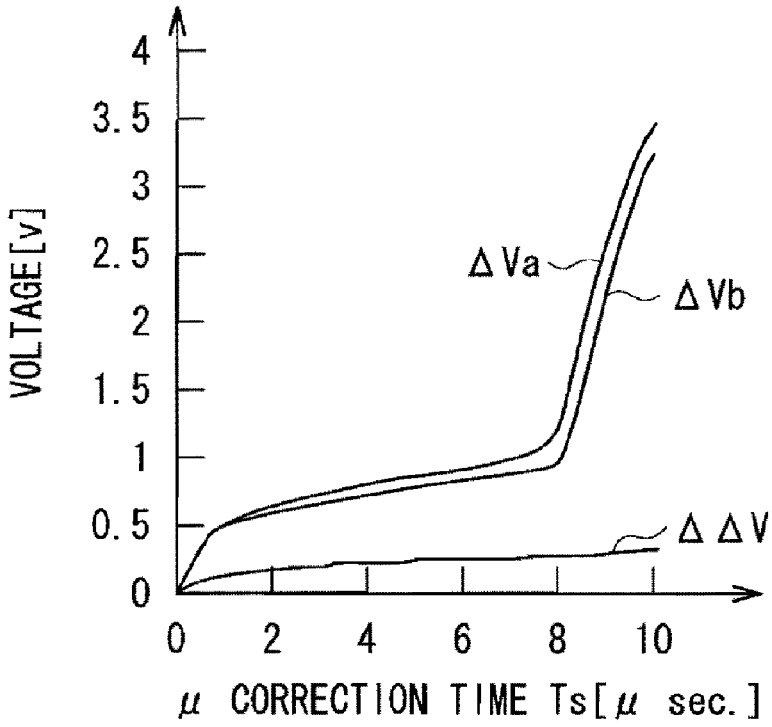
FIG. 4 is a relation diagram illustrating the relation between μ correction time Ts and ΔVa, ΔVb, and ΔΔV when light emission luminance is high.
Figure 5:
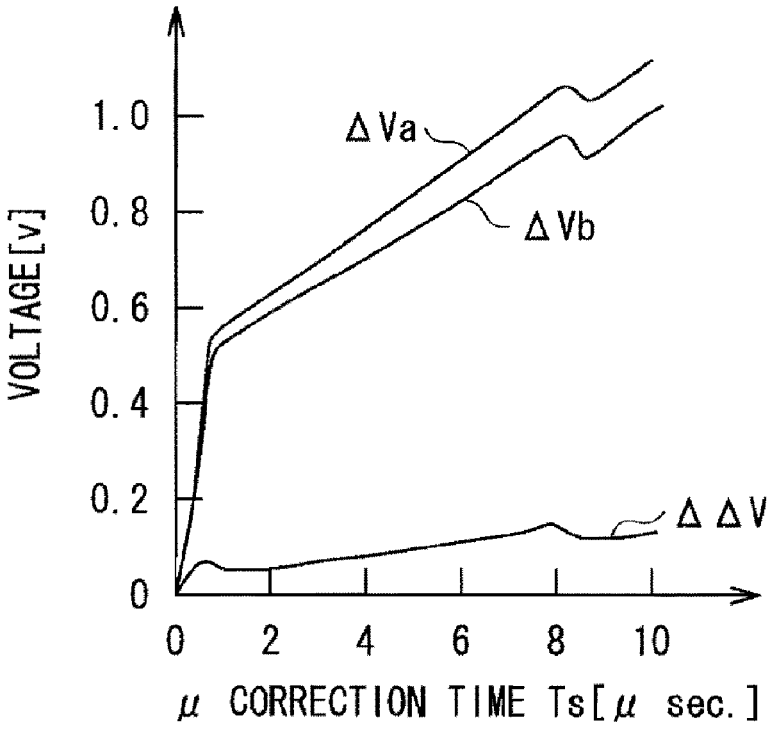
FIG. 5 is a relation diagram illustrating the relation between the μ correction time Ts and ΔVa, ΔVb, and ΔΔV when light emission luminance is low.
Figure 18:
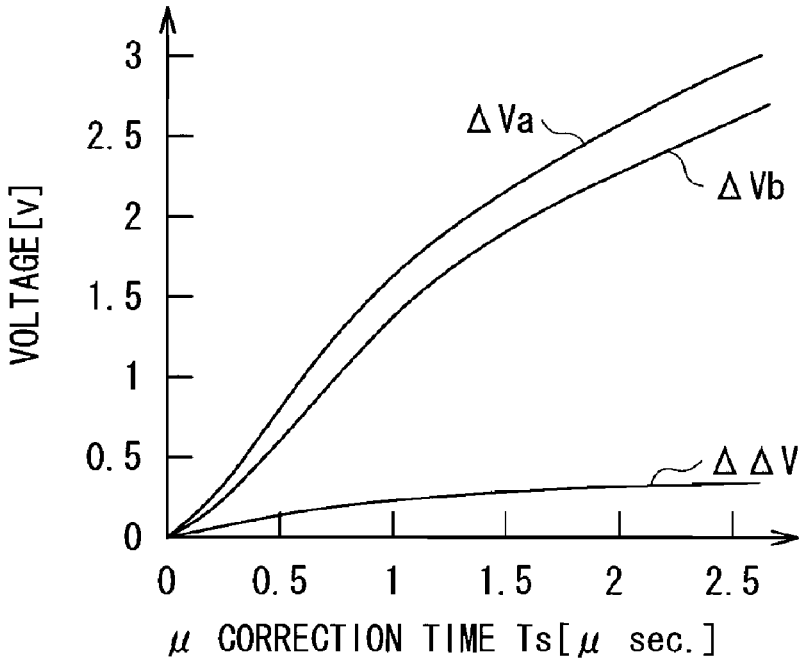
FIG. 18 RELATED ART
FIG. 18 is a relation diagram illustrating the relation between μ correction time Ts and ΔVa, ΔVb, and ΔΔV when light emission luminance is high.
Figure 19:
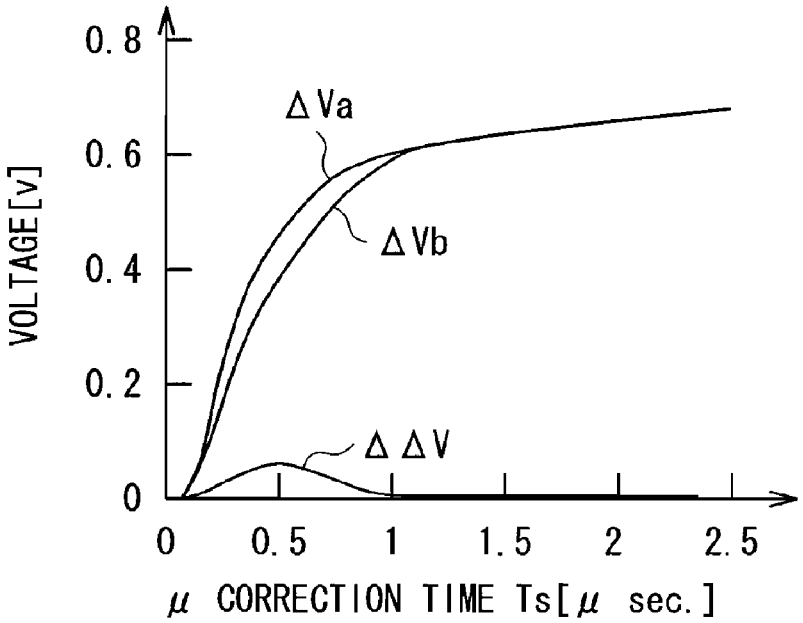
FIG. 19 RELATED ART
FIG. 19 is a relation diagram illustrating the relation between the μ correction time Ts and ΔVa, ΔVb, and ΔΔV when light emission luminance is low.

FIGS. 4 and 5 illustrate an example of the relation between the μ correction time Ts and ΔVa, ΔVb, and ΔΔV when the μ correction and the signal writing operation are performed separately. FIGS. 18 and 19 illustrate an example of the relation between the μ correction time Ts and ΔVa, ΔVb, and ΔΔV when the μ correction and the signal writing operation are performed simultaneously. FIGS. 4 and 18 illustrate the case where the signal voltage Vsig is large (that is, light emission luminance is high). FIGS. 5 and 19 illustrate the case where the signal voltage Vsig is small (that is, light emission luminance is low).

It may be said from FIGS. 4, 5, 18 and 19 that, when the light emission luminance is high, ΔΔV is large to some extent, so that μ correction functions. However, since the mobility of the transistor $T_{Dr}$ is corrected using the voltage Vsig which changes according to the light emission luminance in FIGS. 18 and 19, when the light emission luminance is low, that is, when the voltage Vsig is small, ΔΔV is extremely small, and the μ correction does not function. Since the μ correction and the signal writing are performed simultaneously, the μ correction time Ts becomes inevitably short. Therefore, it is difficult to increase the μ correction time Ts and increase ΔΔV. As the μ correction time Ts is increased, the rise ratio of ΔΔV becomes dull and is saturated to a certain value. Consequently, even if the μ correction time Ts is made longer, it may not be expected that ΔΔV becomes large.

On the other hand, in FIGS. 4 and 5 corresponding to the embodiment, the μ correction and the signal writing operation are performed separately, and the mobility of the transistor $T_{Dr}$ is corrected using the voltage Vofs2 having a predetermined magnitude. Consequently, not only when the light emission luminance is high, but also when the light emission luminance is low, that is, when the voltage Vsig is small, ΔΔV is sufficiently large so that mobility of the transistor $T_{Dr}$ may be corrected irrespective of the light emission luminance. Since the μ correction and the signal writing are performed separately, time necessary to correct the mobility of the transistor $T_{Dr}$ is settable freely (that is, to a proper value). Therefore, in the embodiment, even when light emission luminance is low, the μ correction is made function reliably.

The μ correction time Ts may be changed by changing the timing of starting the signal writing (the timing of increasing the voltage of the gate line WSL from Voff to Von). For example, it may be also changed by changing the arrangement order of three kinds of voltages (Vofs1, Vofs2, and Vsig) output from the horizontal drive circuit 22. In the above, as illustrated in FIG. 6(B), the voltage output from the horizontal drive circuit 22 is changed in order of Vsig, Vofs2, and Vofs1. For example, as illustrated in FIGS. 7(B) and 8(B), the voltage output from the horizontal drive circuit 22 may be changed in order of Vofs1, Vofs2, and Vsig. In the case where the voltage output from the horizontal drive circuit 22 is set in the arrangement order as illustrated in FIGS. 7(B) and 8(B), the timing of starting the signal writing (the timing of increasing the voltage of the gate line WSL from Voff to Von) may be set, for example, in a cycle in which the μ correction is started as illustrated in FIG. 7(A), or in the cycle next to the cycle in which the μ correction is started as illustrated in FIG. 8(A).

MODULE AND APPLICATION EXAMPLES

Application examples of the display device 1 described in the foregoing embodiment will be described below. The display device 1 of the embodiment is applicable to a display device of an electronic device in all of fields for displaying a video signal input from the outside or a video signal generated internally as an image or a video image, such as a television device, a digital camera, a notebook-sized personal computer, a portable terminal device such as a cellular phone, a video camera, or the like.

Module

Figure 9:
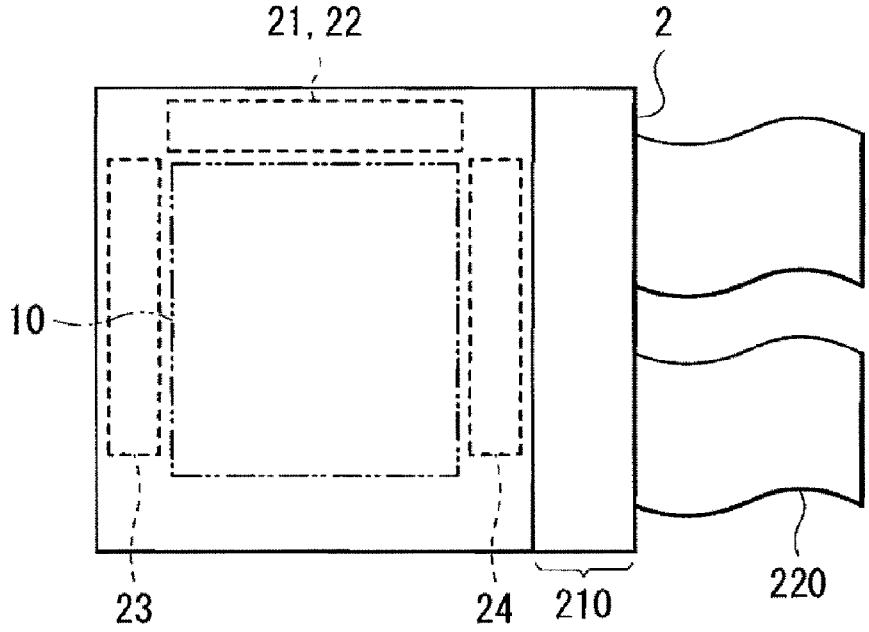
FIG. 9 is a plan view illustrating a schematic configuration of a module including the display device of the embodiment.

The display device 1 of the embodiment is assembled as, for example, a module as illustrated in FIG. 9, into various electronic devices such as application examples 1 to 5 which will be described later. The module is obtained by, for example, providing a region 210 exposed from a member (not illustrated) sealing the display unit 10 in one side of a substrate 2 and forming external connection terminals (not illustrated) by extending wirings of the timing control circuit 21, the horizontal drive circuit 22, the write scan circuit 23, and the power source scan circuit 24 in the exposed region 210. The external connection terminal may be provided with a flexible printed circuit (FPC) 220 for inputting/outputting signals.

Application Example 1

Figure 10:
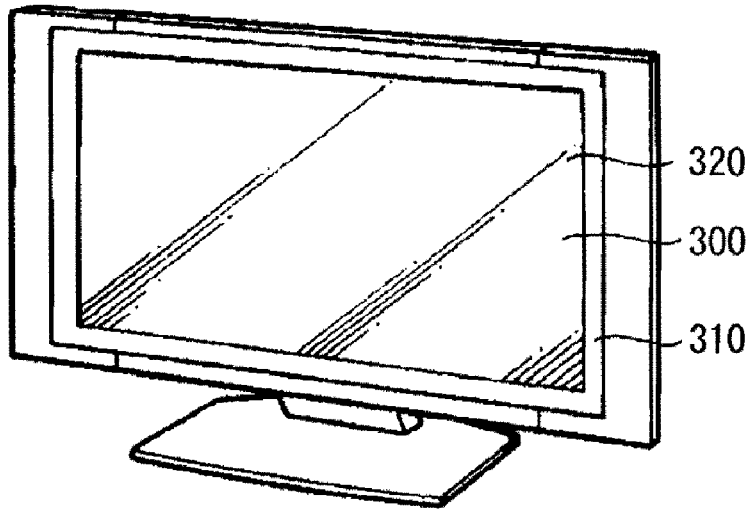
FIG. 10 is a perspective view illustrating the appearance of application example 1 of the display device of the embodiment.

FIG. 10 illustrates the appearance of a television device to which the display device 1 of the embodiment is applied. The television device has, for example, a video display screen unit 300 including a front panel 310 and a filter glass 320. The video display screen unit 300 includes the display device 1 of the embodiment.

Application Example 2

Figure 11A:
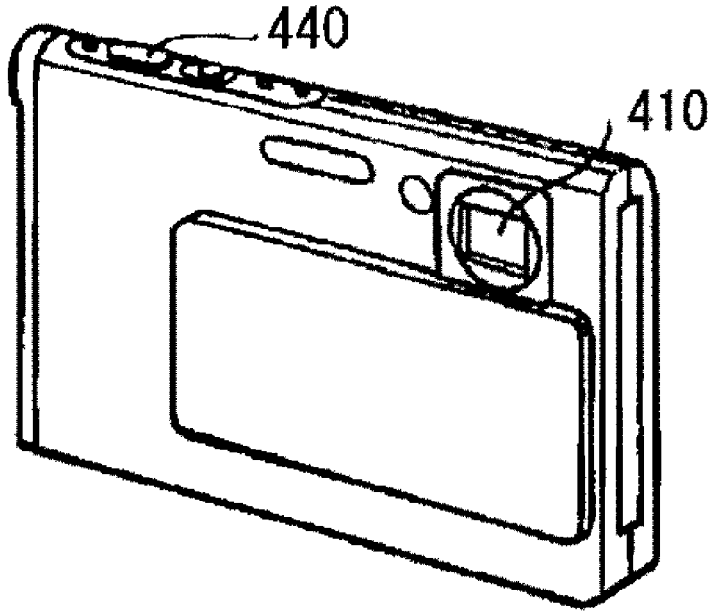
FIG. 11A is a perspective view illustrating the appearance from the front side of application example 2.
Figure 11B:
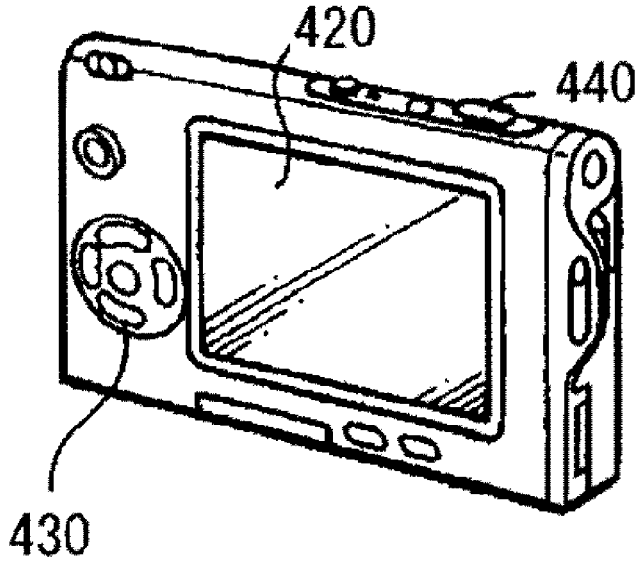
FIG. 11B is a perspective view illustrating the appearance from the back side.

FIGS. 11A and 11B illustrate the appearance of a digital camera to which the display device 1 of the embodiment is applied. The digital camera has, for example, a light emitting unit 410 for flash, a display unit 420, a menu switch 430, and a shutter button 440. The display unit 420 includes the display device 1 of the embodiment.

Application Example 3

Figure 12:
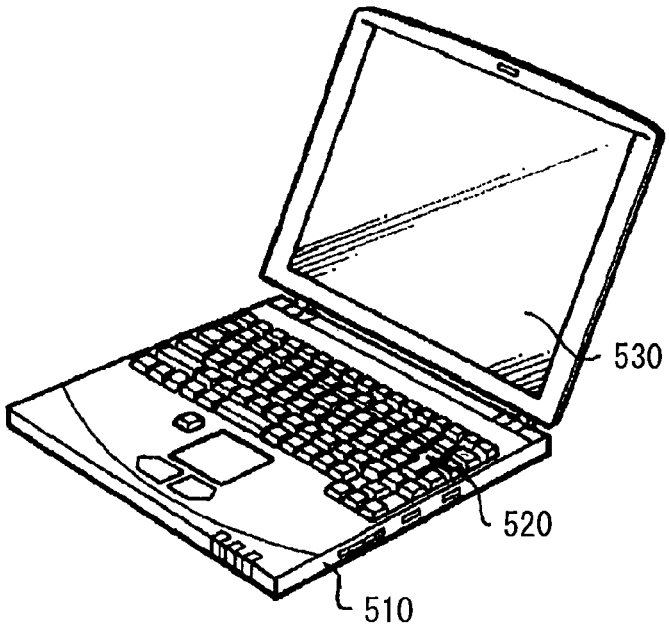
FIG. 12 is a perspective view illustrating the appearance of application example 3.

FIG. 12 illustrates the appearance of a notebook-sized personal computer to which the display device 1 of the embodiment is applied. The notebook-sized personal computer has, for example, a body 510, a keyboard 520 for operation of inputting characters and the like, and a display unit 530 for displaying an image. The display unit 530 includes the display device 1 of the embodiment.

Application Example 4

Figure 13:
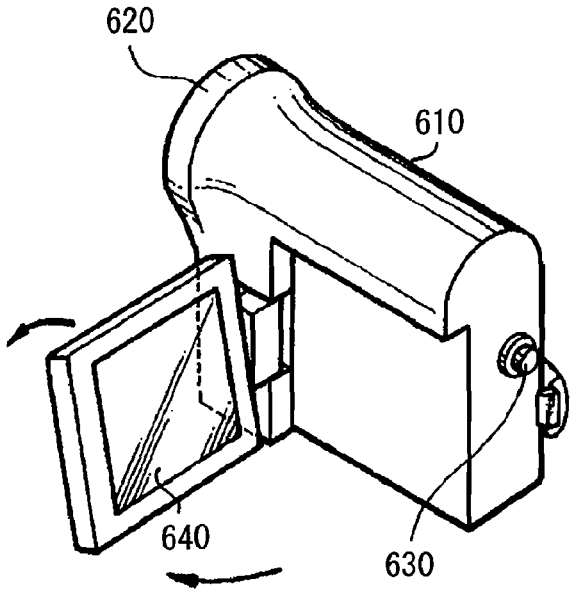
FIG. 13 is a perspective view illustrating the appearance of application example 4.
Figure 15:
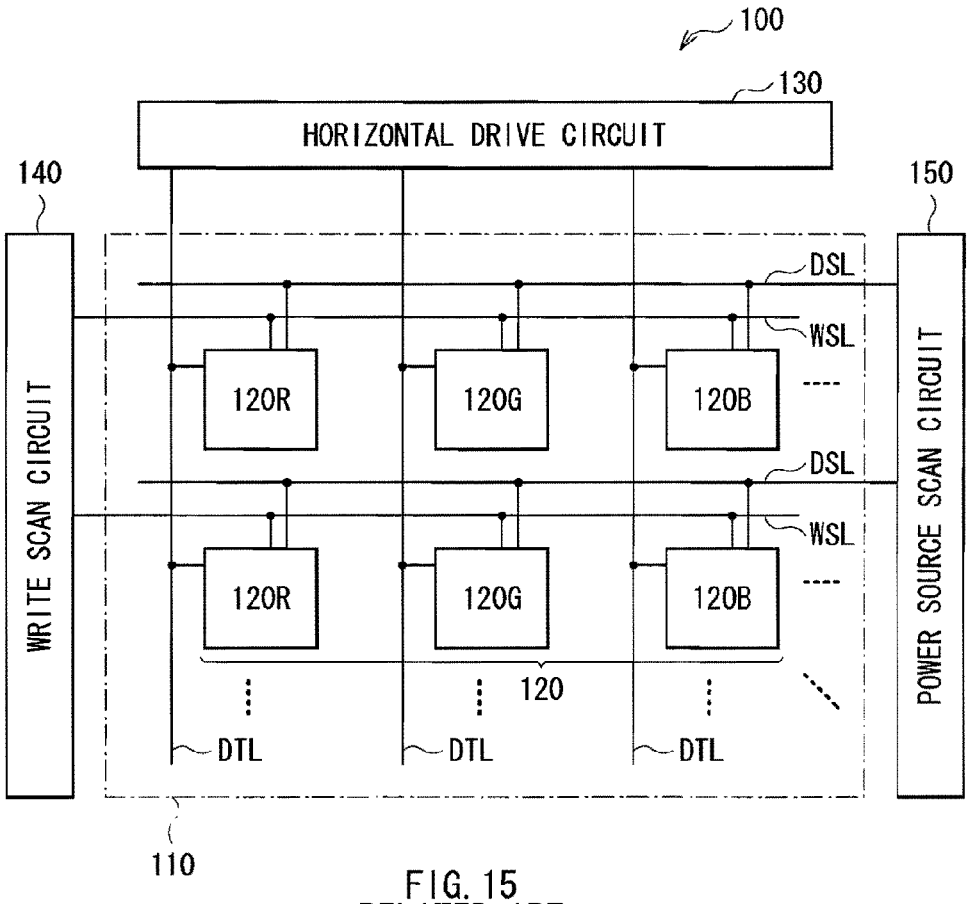
FIG. 15 RELATED ART
FIG. 15 is a configuration diagram illustrating an example of a display device in related art.
Figure 16:
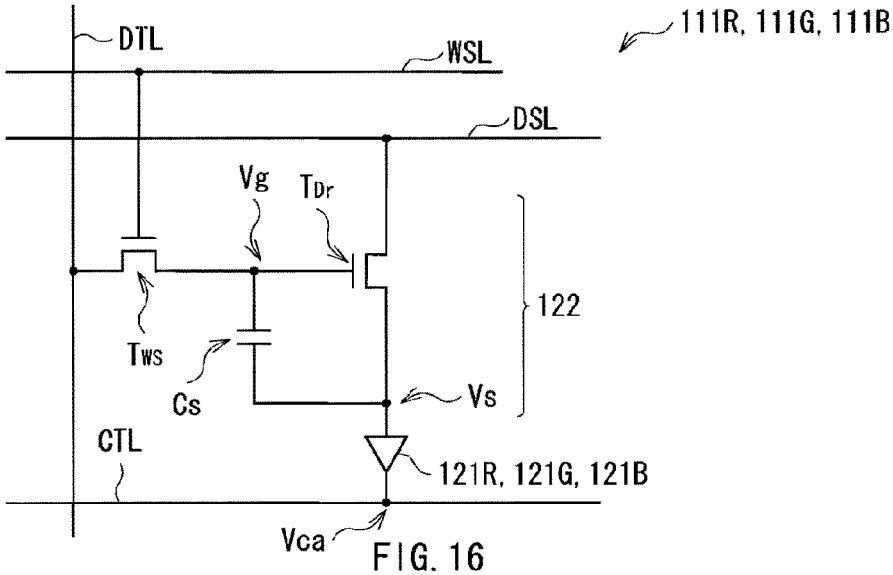
FIG. 16 RELATED ART
FIG. 16 is a configuration diagram illustrating an example of an internal configuration of a pixel in FIG. 15.
Figure 17:
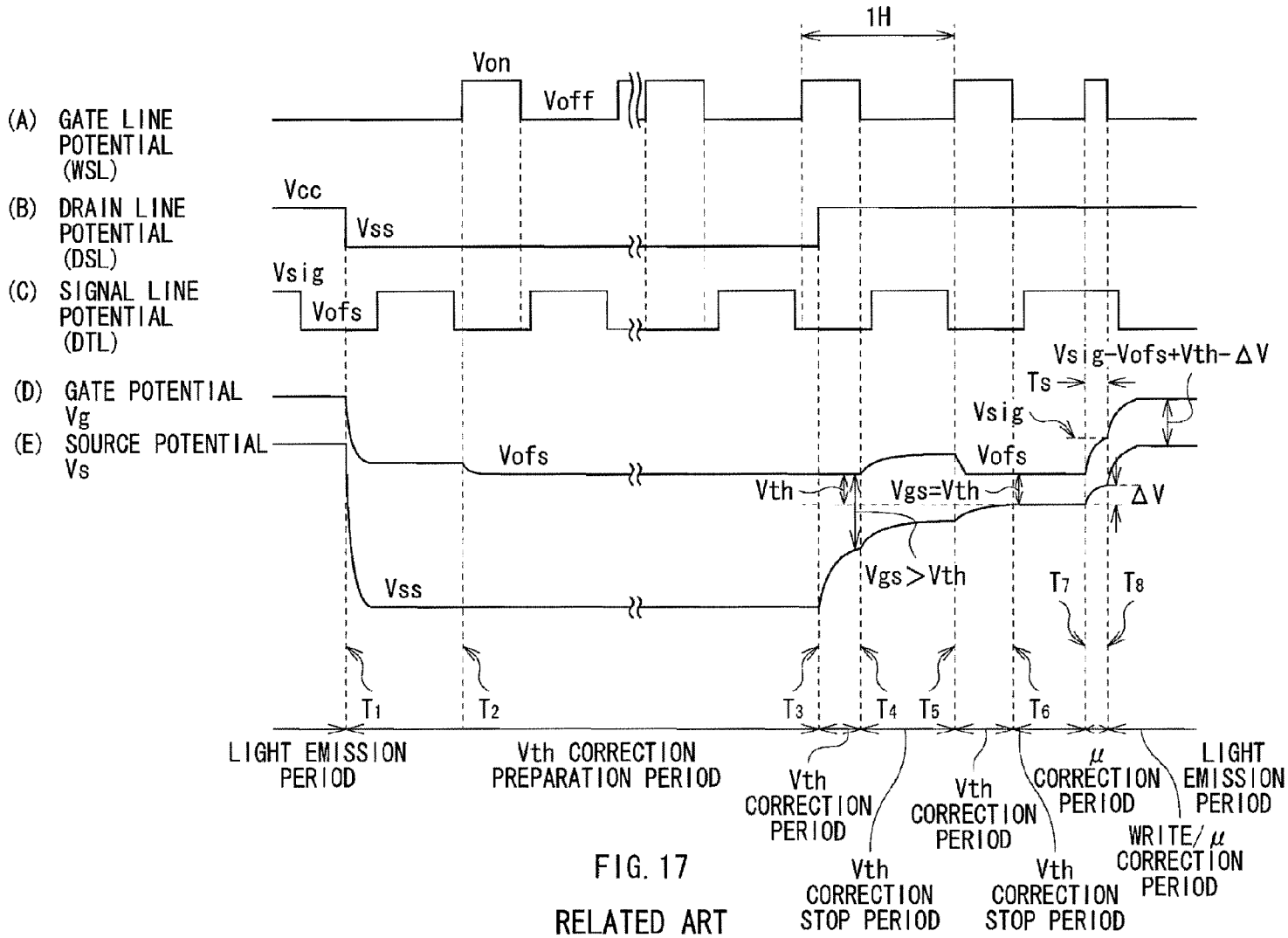
FIG. 17 RELATED ART
FIG. 17 is a waveform chart for explaining an example of the operation of the display device of FIG. 15.

FIG. 13 illustrates the appearance of a video camera to which the display device 1 of the embodiment is applied. The video camera has, for example, a body 610, a lens 620 for capturing a subject, provided in the front face of the body 610, a shooting start/stop switch 630, and a display unit 640. The display unit 640 includes the display device 1 of the embodiment.

Application Example 5

FIGS. 14A to 14G illustrate the appearance of a cellular phone to which the display device 1 of the embodiment is applied. The cellular phone, for example, couples an upper casing 710 and a lower casing 720 by a coupling part (hinge) 730 and has a display 740, a sub-display 750, a picture light 760, and a camera 770. The display 740 or the sub-display 750 is constructed by the display device 1 of the embodiment.

Although the present invention has been described above by the embodiment and the application examples, the present invention is not limited to the embodiment and the like but may be variously modified.

For example, in the embodiment and the like, the case where the display device 1 is of an active matrix type has been described. However, the configuration of the pixel circuit 13 for active matrix drive is not limited to that described in the foregoing embodiment and the like. As necessary, a capacitive element and a transistor may be added to the pixel circuit 13. In this case, according to a change in the pixel circuit 13, a necessary drive circuit may be provided in addition to the horizontal drive circuit 22, the write scan circuit 23, and the power source scan circuit 24.

In the embodiment and the like, the driving of the horizontal drive circuit 22, the write scan circuit 23, and the power source scan circuit 24 is controlled by the signal retention control circuit 21B. However, the driving of the circuits may be controlled by another circuit. The horizontal drive circuit 22, the write scan circuit 23, and the power source scan circuit 24 may be controlled by hardware (circuit) or software (program).

Although the pixel circuit 13 has the circuit configuration of 2Tr1C in the foregoing embodiment and the like, as long as the circuit configuration that a transistor is connected in series to the organic EL element 12R or the like is included, a circuit configuration other than the circuit configuration of 2Tr1C may be employed.

Although the case where the transistors Tws and $T_{Dr}$ are thin film transistors (TFTs) of the n-channel MOS type has been described in the foregoing embodiment and the like, they may be p-channel transistors (for example, TFTs of the n-channel MOS type). In this case, it is preferable to connect the source or drain of the transistor $T_{Dr}$, which is not connected to the drain line DSL, and the other end of the retention capacitor Cs to the cathode of the organic EL element 12R or the like, and connect the anode of the organic EL element 12R or the like to the cathode line CTL.

The present application contains subject matter related to that disclosed in Japanese Priority Patent Application JP 2008-197912 filed in the Japan Patent Office on Jul. 31, 2008, the entire contents of which is hereby incorporated by reference.

Obviously many modifications and variations of the present invention are possible in the light of the above teachings. It is therefore to be understood that within the scope of the appended claims the invention may be practiced otherwise than as specifically described.

What is claimed is:

1. A display device comprising:

a display unit having a plurality of pixels with each pixel having (i) a light emitting element and (ii) a pixel circuit; and a drive unit operable to drive the pixel circuits based on a video signal, wherein, each pixel circuit includes at least one transistor connected in series to the light emitting element, and the drive unit includes, (i) a first drive unit operable to supply a first voltage from a source or a drain of the transistor on the side opposite to the light emitting element, the first voltage being a voltage equal to or larger than a threshold voltage of the light emitting element, to the light emitting element, (ii) a second drive unit operable to supply three different kinds of voltages to a gate of the transistor including (a) a second voltage having a magnitude based on the video signal and (b) a third voltage having a predetermined magnitude from the gate of the transistor and (c) a fourth voltage having a magnitude less than the third voltage, and (iii) a control unit operable to (a) correct the potential difference between the gate and the source of the transistor to a threshold voltage of the transistor, (b) output a control signal a first time starting correction of mobility of the transistor while the second drive unit outputs the third voltage, and (c) output a control signal a second time starting writing of a voltage according to the second voltage to the gate of the transistor while the second drive unit outputs the second voltage.

2. The display device according to claim 1, wherein the second drive unit is operable to change correction time by supplying the second, third, and fourth voltages in different orders.

3. A method of driving a display device with (i) a display unit having a plurality of pixels with each pixel having (a) a light emitting element and (b) a pixel circuit, and (ii) a drive unit operable to drive the pixel circuits based on a video signal, each pixel circuit includes at least one transistor connected in series to the light emitting element, the drive unit including (a) a first drive unit operable to supply a first voltage from a source or a drain of the transistor on the side opposite to the light emitting element, the first voltage being a voltage equal to or larger than a threshold voltage of the light emitting element, to the light emitting element, and (b) a second drive unit operable to supply three different kinds of voltages to a gate of the transistor including a second voltage having a magnitude based on the video signal, a third voltage having a predetermined magnitude from the gate of the transistor and a fourth voltage having a magnitude less than the third voltage, the method comprising:

correcting the potential difference between the gate and the source of the transistor to a threshold voltage of the transistor;

starting correction of mobility of the transistor while the second drive unit outputs the third voltage; and starting writing of a voltage according to the second voltage to the gate of the transistor while the second drive unit outputs the second voltage.

4. The method according to claim 3, changing correction time by supplying the second, third, and fourth voltages of the second drive unit in various orders.

5. An electronic device having a display device, the display device comprising:

a display unit having a plurality of pixels with each pixel having (i) a light emitting element and (ii) a pixel circuit; and a drive unit operable to drive the pixel circuits based on a video signal, wherein, the pixel circuit circuits include at least one transistor connected in series to the light emitting element, and the drive unit includes, (i) a first drive unit operable to supply a first voltage of the at least three kinds of voltages from a source or a drain of the transistor on the side opposite to the light emitting element, the first voltage being a voltage equal to or larger than a threshold voltage of the light emitting element, to the light emitting element, a second drive unit operable to supply three different kinds of voltages to a gate of the transistor including (a) a second voltage having a magnitude based on the video signal, (b) a third voltage having a predetermined magnitude from the gate of the transistor, and (c) a fourth voltage having a magnitude less than the third voltage, and a control unit operable to (a) correct the potential difference between the gate and the source of the transistor to a threshold voltage of the transistor, (b) output a control signal a first time starting correction of mobility of the transistor while the second drive unit outputs the third voltage, and (c) output a control signal a second time starting writing of a voltage according to the second voltage to the gate of the transistor while the second drive unit outputs the second voltage.

6. The display device according to claim 5, wherein the second drive unit is operable to change correction time by supplying the second, third, and fourth voltages in different orders.

* * * * *